US006826884B2

(12) United States Patent
Pabedinskas et al.

(10) Patent No.: US 6,826,884 B2
(45) Date of Patent: Dec. 7, 2004

(54) HOLLOW FLANGED JOIST FOR DECK FRAMING

(76) Inventors: Arunas Antanas Pabedinskas, 12 Laurel Avenue, Etobicoke, Ontario (CA), M9B 4S8; Werner Karl Hermann Gregori, 8 Lakewood Ct., Hawkstone, Ontario (CA), L0L 1T0

( * ) Notice: Subject to any disclaimer, the term of this patent is extended or adjusted under 35 U.S.C. 154(b) by 50 days.

(21) Appl. No.: 10/222,970

(22) Filed: Aug. 19, 2002

(65) Prior Publication Data

US 2004/0031230 A1 Feb. 19, 2004

(51) Int. Cl.[7] ..... E04H 15/32

(52) U.S. Cl. ..... 52/729.1; 52/729.3; 52/730.4; 52/737.6

(58) Field of Search ..... 52/729.1, 729.3, 52/730.4, 737.6, 737.1, 731.2, 731.7, 606, DIG. 9; D25/122

(56) References Cited

U.S. PATENT DOCUMENTS

| | | | | |
|---|---|---|---|---|
| 1,377,891 A | | 5/1921 | Knight | |
| 1,760,331 A | * | 5/1930 | White | 52/354 |
| 2,844,023 A | * | 7/1958 | Maiwurm | 52/223.8 |
| 3,487,518 A | | 1/1970 | Hopfeld | |
| 3,753,326 A | * | 8/1973 | Kaufman, Sr. | 52/731.7 |
| 4,020,202 A | | 4/1977 | Kreft | |
| 5,241,795 A | * | 9/1993 | Giroux et al. | 52/503 |
| 5,511,355 A | | 4/1996 | Dingler | |
| 5,555,695 A | * | 9/1996 | Patsy, Jr. | 52/730.4 |
| 5,596,843 A | * | 1/1997 | Watson | 52/71 |
| D378,424 S | * | 3/1997 | Leonelli | D25/122 |
| 5,706,620 A | * | 1/1998 | De Zen | 52/220.2 |
| 5,848,512 A | | 12/1998 | Conn | |
| 6,012,262 A | | 1/2000 | Irving | |
| 6,086,084 A | * | 7/2000 | Wemmenhove | 280/602 |
| 6,332,301 B1 | * | 12/2001 | Goldzak | 52/729.2 |
| 6,408,591 B1 | * | 6/2002 | Yamashita et al. | 52/731.6 |
| 6,591,558 B1 | * | 7/2003 | De Zen | 52/91.3 |
| 6,615,564 B2 | * | 9/2003 | Lutrario et al. | 52/765 |

OTHER PUBLICATIONS

Strongwell, FRP Composites Used in Bridge Infrastructure, http://www.strongwell.com/Special/bridges.htm. Jun. 26, 2002, pp. 1–4.

Strongwell, FRP Composites Used in Bridge Infractrure, http://www.strongwell.com/Special/bridges.htm. Special Market Products, Bridge Superstructure and Deck System Components and Applications, Jun. 12, 2002, pp. 1–4.

* cited by examiner

*Primary Examiner*—Carl D. Friedman
*Assistant Examiner*—Basil Katcheves
(74) *Attorney, Agent, or Firm*—Nancy E. Hill; Hill & Schumacher

(57) ABSTRACT

A hollow flanged joist comprises a center web section and top and bottom flange sections containing hollow channels. The center web section has two parallel vertical webs and at least one horizontal web extending perpendicularly between the vertical webs. The top and bottom flange sections each extend outwardly and perpendicularly from each end of the center web section and consist of a horizontal end web, two vertical side webs extending inwardly from the far ends of the end web, two horizontal inner webs extending between the inner ends of the side webs and center vertical webs, and, optionally, a number of vertical support webs extending between the end web and the outermost center horizontal web or the inner webs. Preferably, the hollow flanged joist is made from moisture resistant materials and is dimensioned comparably to wooden joists.

35 Claims, 10 Drawing Sheets

HOLLOW FLANGED JOIST FOR DECK FRAMING

FIELD OF THE INVENTION

This invention is directed to decks and other outside constructions, and in particular to a hollow flanged joist which can be used in place of wooden joists in framing.

BACKGROUND TO THE INVENTION

The majority of decks built in North America are constructed from wood, this includes the framing as well as the decking surface. However, with age and exposure to moisture, wood can split, warp, splinter and rot. These effects are most apparent on the horizontal decking surfaces where water can collect, especially if the deck boards become cupped. Recently, a number of manufacturers have started offering profiles made from moisture resistant materials which can be used as an alternative to wood decking in the construction of decks. These non-wood decking products, such as those produced by Trex Company Inc., Winchester, Va., and Advanced Environmental Recycling Technologies Inc. (AERT), Springdale, Ariz., are said to offer a number of advantages over wood, particularly relating to the moisture resistance of the materials used in their manufacture.

While there are a growing number of manufacturers of these non-wood decking products, most of these manufacturers recommend against using their products as structural members, such as joists. Typically, the manufacturers of the non-wood decking products recommend using wood to construct the structure on which the non-wood decking product is installed. This results in a decking surface which may have a lifetime guarantee, while the wooden structure supporting it is still prone to moisture damage and may need replacement if the damage is severe enough. The effects of moisture on the framing can be minimized by using naturally moisture resistant wood species such as cedar or redwood, which are usually sold at a substantial premium to less moisture resistant species. A more economical solution has been to use pressure treated lumber as the framing members with the non-wood decking products. However, the effect of the pressure treating will decrease over time as the chemicals leach out of the wood. As such, using moisture resistant wood species and pressure treated lumber will delay the decay of the wood, but it will not prevent splitting, warping and splintering of the wood, which is caused by repeated cycles of the wood getting wet and drying out and can significantly weaken the structural members.

In February of 2002, the United States Environmental Protection Agency announced a phase-out of chromated copper arsenate (CCA) treated lumber by the treated lumber industry. At the time, CCA treated lumber accounted for over 80% of pressure treated lumber sold in North America. The phase out was the result over the concerns over the toxicity of the CCA and the fact that it can readily leach out from lumber and contaminate nearby soil. Other chemical preservatives are available with the most likely successor to CCA being alkaline copper quaternary (ACQ), which is substantially more expensive than CCA, and will result in higher treated lumber prices. These various chemical formulations used in pressure treating typically act as fungicides which enhance the moisture resistance of the wood by killing fungi which can lead to rot and decay. However, according to the Canadian Environment Ministry, all chemical wood preservatives are classified as pesticides as they achieve decay control as a result of their significant toxicity, and that while the potency of the various preservatives varies, all are poisonous to some degree and are potentially hazardous to humans and other forms of life. In addition, as a result of increased demand, the phase out of CCA treated lumber has resulted in increased prices for lumber from moisture resistant wood species such as cedar.

Currently, there is only one type of product which is being promoted for use as structural members to replace wood framing in building decks, and that is glass fiber reinforced high density polyethylene (HDPE) plastic lumber, such as that produced by US Plastic Lumber Ltd., Boca Raton, Fla. These products are usually solid and mimic the sizes and shape of standard lumber profiles (i.e. 2×6, 2×8, etc.). However, as a result of the significantly higher density of these products, they are substantially heavier than wood of the same size. In addition, as the mechanical properties (particularly the flexural modulus) of these products are typically lower than wood, they cannot span as far as similarly sized wood joists. As a result of the glass fiber content, these products can be difficult to cut and drill and can quickly dull saw blades and drill bits. Finally, because of the relatively high cost of the glass fiber reinforcement, the cost of these products can be many times that of wood even when they are produced using recycled HDPE.

One way to reduce the cost of a joist is to reduce the amount of material used in its production by concentrating the material used to where the most stress is experienced. In a joist, which is typically exposed to bending loads, the most stress is at the top and bottom surfaces of the joist. It is well known that I-shaped flanged beams are very efficient at resisting bending loads as are typically seen in construction applications and have a greater strength to weight ratio than similarly sized solid beams because the material of the beam is concentrated where the greatest stresses are experienced. Another way to reduce the weight of a beam is to make it hollow rather than solid. This offers two advantages. First, less material is used, which reduces the cost. Second, by reducing the weight of the beam it reduces the load on any support structure for the beam.

Therefore it would be desirable to have a product which could be used to replace untreated lumber, pressure treated lumber, cedar and redwood in framing for decks which use moisture resistant non-wood decking products. Preferably the product has the same moisture resistant characteristics of the non-wood decking products. Preferably it should be easy to work with (i.e. have the workability of wood), be easy to install and, where possible, offers additional features. In order to address the concerns regarding the weight, the flexibility and the cost of currently available non-wood products sold for use as structural framing members for decks, preferably the product makes use of the structural advantages of a flanged beam configuration and the weight savings of a hollow profile.

SUMMARY OF THE INVENTION

The invention involves a hollow flanged joist, produced via extrusion or pultrusion, which is intended to be used as a framing member in the construction of decks or other exterior structures and has a shape substantially that of a I-shaped beam.

The hollow flanged joist consists of a center web section and top and bottom flange sections. The center web section has two generally parallel center vertical webs and at least one center horizontal web. The center horizontal web extends between the center vertical webs and is generally perpendicular thereto. The center web section has a top end and a bottom end. The top flange section extends outwardly and generally perpendicularly from the top end of the center web section on each side thereof. The top flange section has a horizontal flange end web, a pair of vertical flange side webs extending downwardly from the ends of the flange end web and a pair of horizontal flange inner webs. One of the pair of horizontal flange inner webs extends inwardly from the inner end of each flange side web and connects to the adjacent center vertical web. The bottom flange section extends outwardly and generally perpendicularly from the bottom end of the center web section on each side thereof. The bottom flange section has a horizontal flange end web, a pair of vertical flange side webs extending upwardly from the ends of the flange end web and a pair of horizontal flange inner webs. One of the pair of horizontal flange inner webs extends inwardly from the inner end of each flange side web and connects to the adjacent center vertical web.

Optionally the top and bottom flange sections may also each have a number of flange support webs which can extend between the respective flange end web and the adjacent outermost center horizontal web or the flange inner webs. In a preferred embodiment, the flange support webs are positioned such that they are in line with the center vertical webs.

Preferably the hollow flanged joist is made from a moisture resistant material such as a thermoplastic or thermosetting resin which may or may not contain reinforcing fillers whose purpose is to increase the strength and stiffness of the profile. Further, the choice of the moisture resistant material should yield a product with sufficient strength and rigidity as to be a cost effective replacement for wood framing members.

Preferably, the hollow flanged joist is dimensioned such that it can easily be substituted for the wood framing members it is meant to replace. Further, the design should allow for easy joining of the hollow flanged joists in framing a deck and incorporate features which increase the functionality of the product by indicating the preferred location for fasteners and the like.

In another preferred form, the hollow flanged joist will be designed such that the hollow channels are sized so that reinforcing inserts can be introduced into the hollow flanged joist to increase the strength and stiffness of the profile.

Other features and advantages of this invention will become apparent from the following description taken in conjunction with the accompanying drawings wherein are set forth, by way of illustration and example, certain embodiments of this invention. The drawings constitute a part of this specification and include exemplary embodiments and illustrate various features and designs thereof.

BRIEF DESCRIPTION OF THE DRAWINGS

The invention will now be described by way of example only, with reference to the accompanying drawings, in which.

DETAILED DESCRIPTION OF THE INVENTION

Although the invention will be described in terms of specific embodiments, it will be readily apparent to those skilled in the art that various modifications, rearrangements and substitutions can be made without parting from the spirit of this invention.

Figure 1:
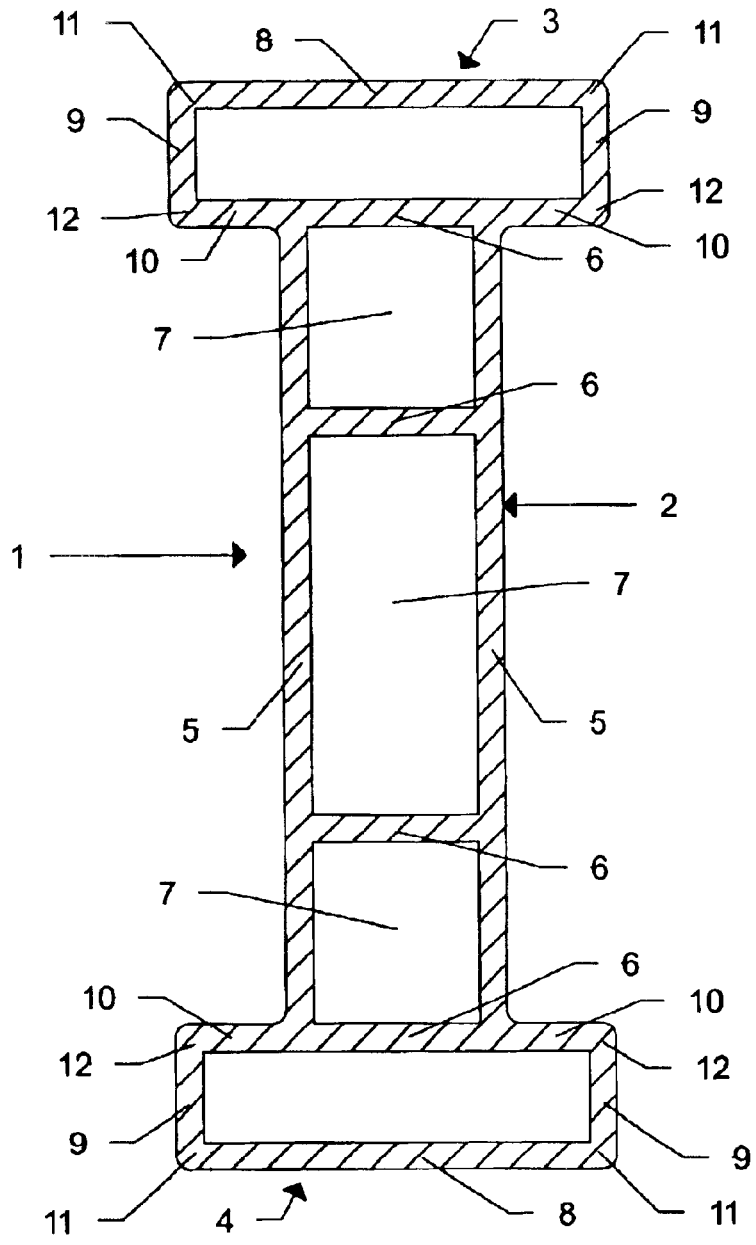
FIG. 1 is a cross-sectional view of one embodiment of a hollow flanged joist of the present invention.
Figure 2:
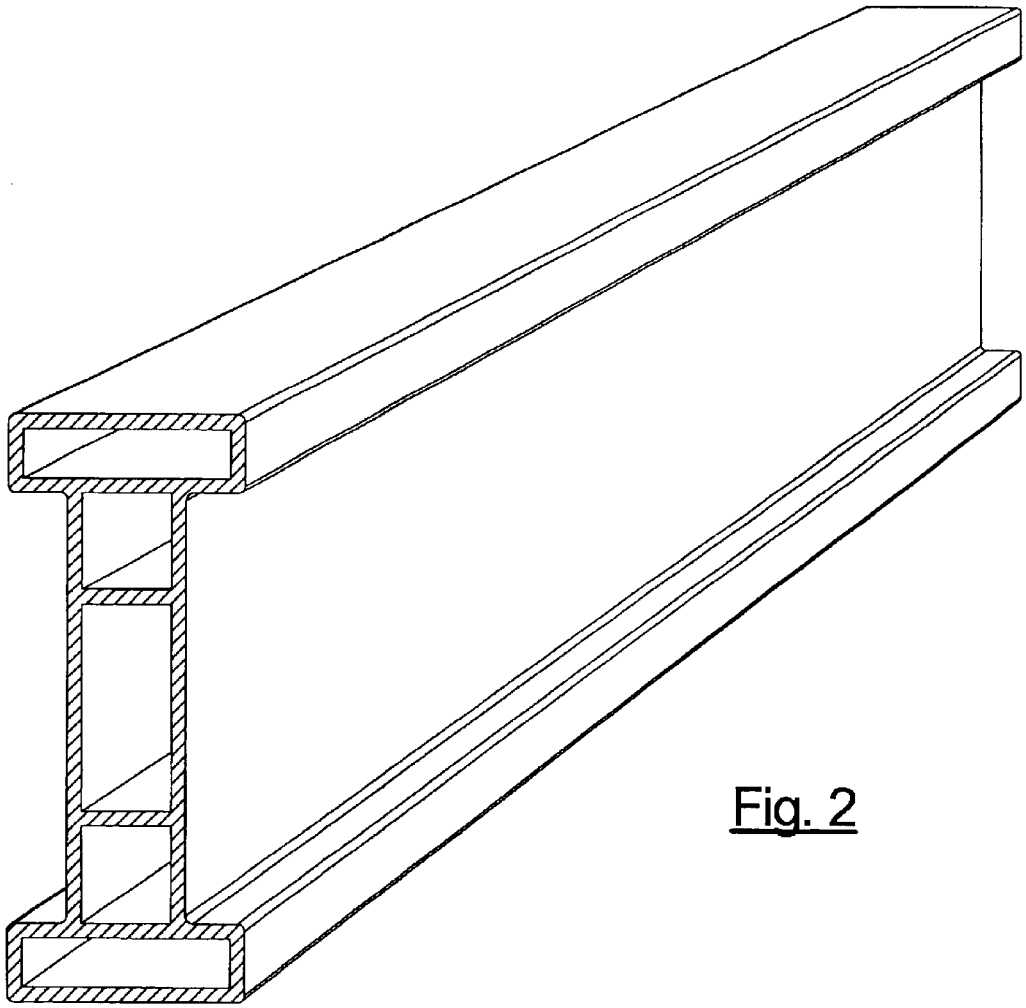
FIG. 2 is a perspective view of the hollow flanged joist of the present invention shown in FIG. 1.

FIG. 1 shows a cross-sectional view of one embodiment of the hollow flanged joist 1 of the present invention, while FIG. 2 shows a perspective view of the same embodiment. As can be seen, hollow flanged joist 1 has a shape generally that of an I-shaped beam with center web section 2 and top 3 and bottom 4 flange sections, all of which have a cross-section which is constant in the longitudinal direction. The center web section 2 consists of two parallel center vertical webs 5 of equal length and a plurality of parallel center horizontal webs 6 of equal length which are perpendicular to the center vertical webs 5. The center horizontal webs 6 extend between the center vertical webs 5 and define a plurality of hollow channels 7 in the longitudinal direction of the hollow flanged joist 1. The top 3 and bottom 4 flange sections each consist of a horizontal flange end web 8, two parallel vertical flange side webs 9 and two horizontal flange inner webs 10. The top and bottom pairs of the flange side webs 9 are of equal length, are perpendicular to and are connected to the outside ends 11 of the flange end webs 8. The flange inner webs 10 of the top 3 and bottom 4 flange sections are of equal length and are parallel to the flange end webs 8. Inner flange webs 10 are perpendicular to and connected to the inner ends 12 of the flange side webs 9 at the outside end and to the adjacent center vertical webs 5 at the inside end.

Figure 3:
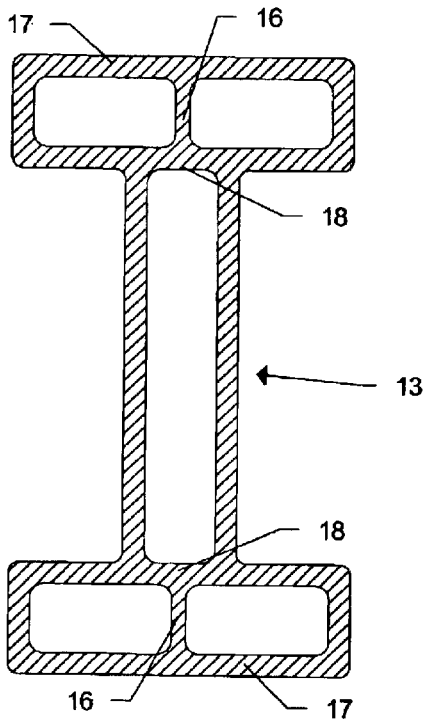
FIG. 3 is a cross-sectional view of a second embodiment of a hollow flanged joist of the present invention.
Figure 4:
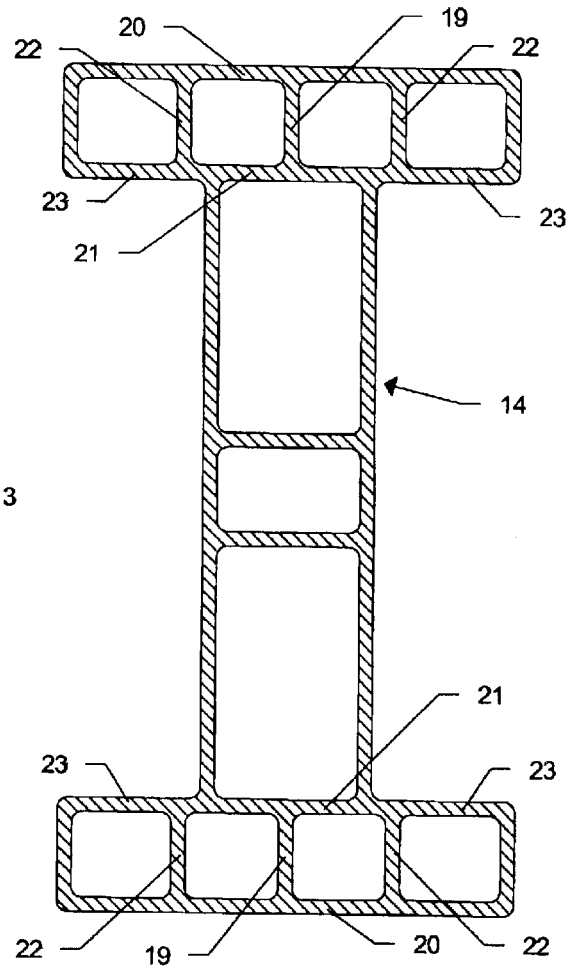
FIG. 4 is a cross-sectional view of a third embodiment of a hollow flanged joist of the present invention.
Figure 5:
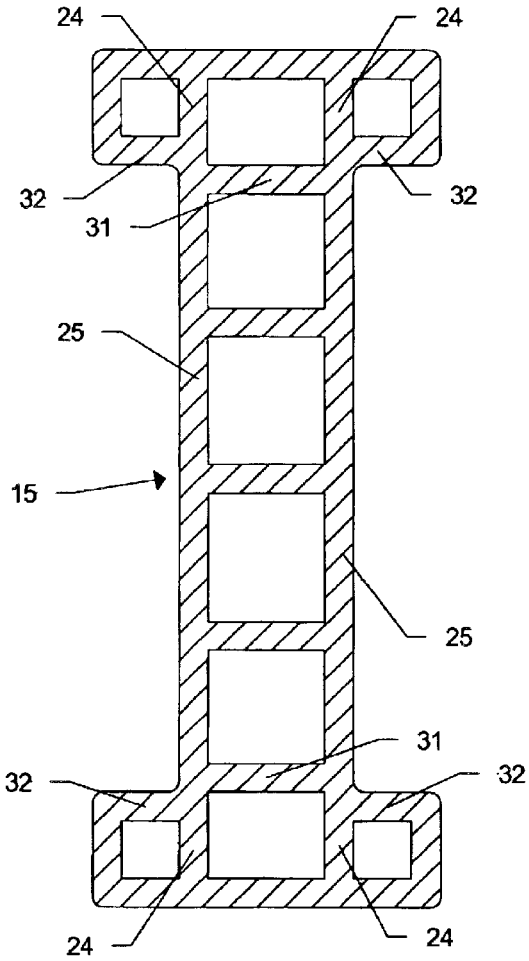
FIG. 5 is a cross-sectional view of a fourth embodiment of a hollow flanged joist of the present invention.

FIGS. 3, 4 and 5 show second 13, third 14 and fourth 15 embodiments, respectively, of the hollow flanged joist of this invention. As can be seen from these embodiments a wide range of designs are possible which will vary in the overall height and width of the hollow flanged joist, the thickness of webs, the number and placement of the center horizontal webs (and consequently the number and placement of the hollow channels in the center web), the height of the flanges (or length of flange side webs) and the thickness of the center web section. The specific dimensions of the hollow flanged joist can be tailored to the given application. In addition, the webs can be all the same thickness or have different thicknesses, however if the hollow flanged joist is to be extruded from a thermoplastic material it is generally preferred to have all the webs of equal thickness in order to better balance the flow in the extrusion die.

The hollow flanged joists 13, 14, 15 shown in FIGS. 3, 4 and 5 differ from the hollow flanged joist 1 shown in FIG. 1 in that each of those joists has one or more flange support webs. For the hollow flanged joist 13 shown in FIG. 3, the flange support webs 16 extend between the flange end webs 17 and the outermost center horizontal webs 18. In addition to flange support webs 19 between the flange end webs 20 and the outermost center horizontal webs 21, the hollow flanged joist 14 shown in FIG. 4 also has flange support webs 22 which extend from the flange end webs 20 and the flange inner webs 23. A preferred position for the flange support webs is shown in FIG. 5, where the flange support webs 24 are positioned such that they are in line with the center vertical webs 25.

Figure 6:
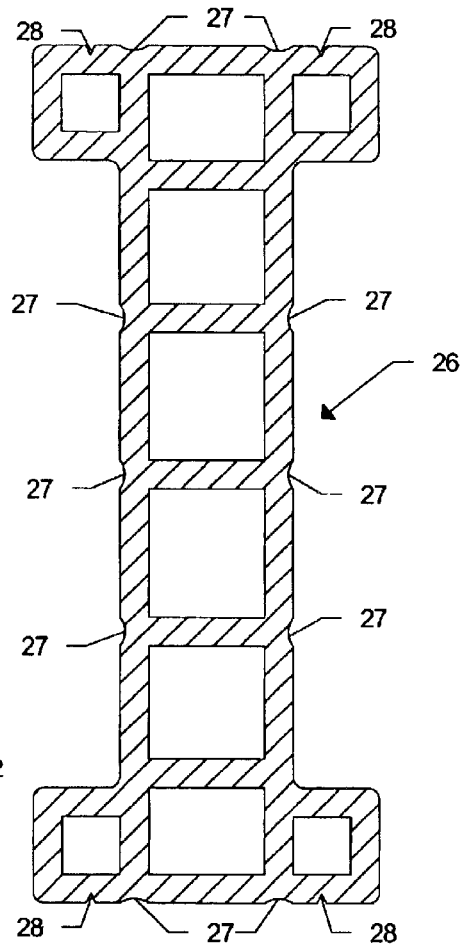
FIG. 6 is a cross-sectional view of the hollow flanged joist shown in FIG. 5 with integral surface markings added.

FIG. 6 shows a hollow flanged joist 26 similar to the hollow flanged joist 15 shown in FIG. 5, except that hollow flanged joist 26 has integral surface markings included in its design. These markings can be used to indicate the location of internal webs 27, appropriate locations 28 for fasteners such as screws, the proper location for brackets used to join two hollow flanged joist, and the like.

Figure 8:
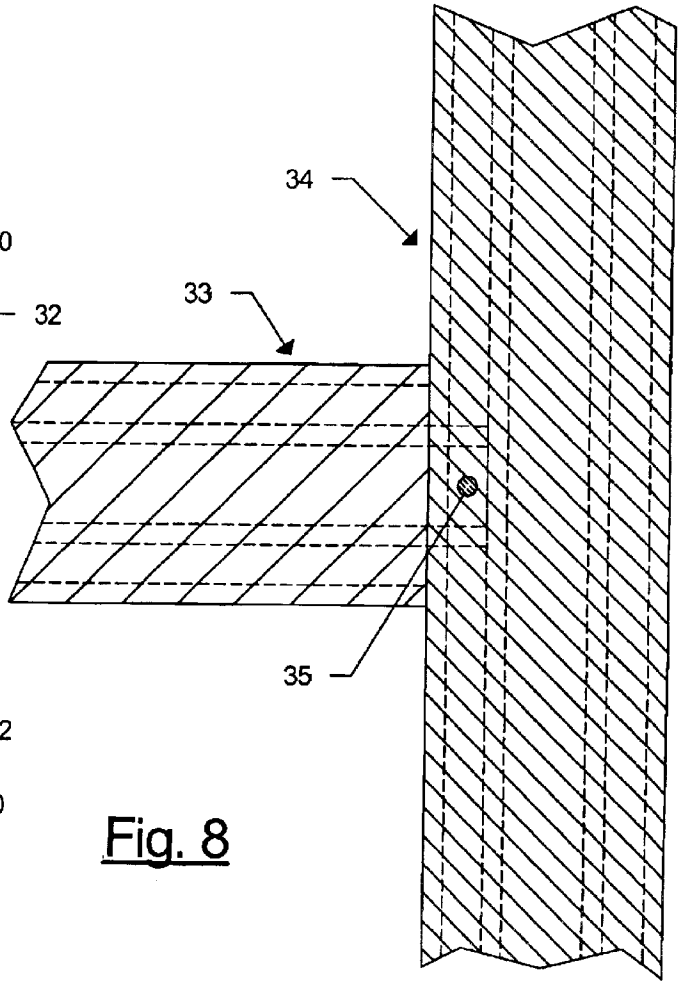
FIG. 8 is a top view of two hollow flanged joists like that shown in FIG. 5 joined in a perpendicular arrangement.
Figure 7:
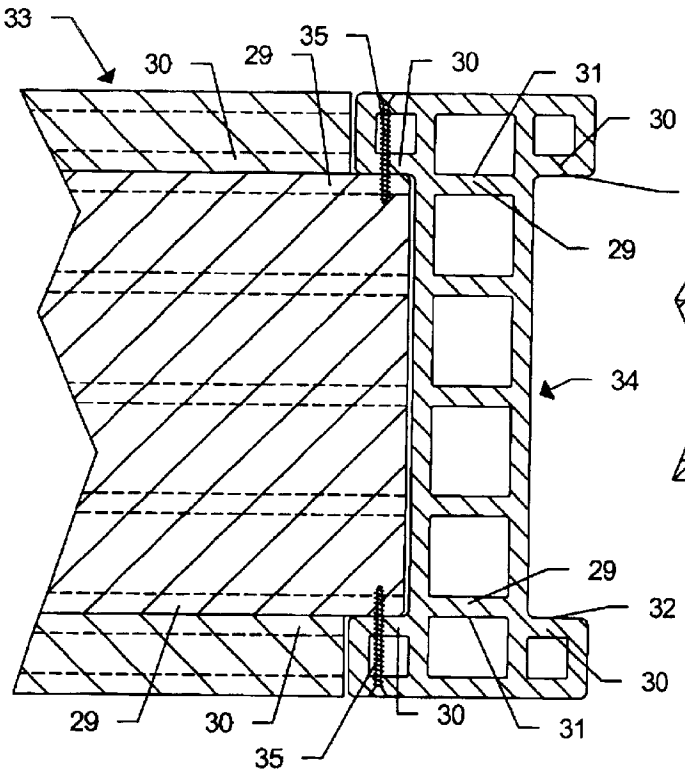
FIG. 7 is a cross-sectional view of two hollow flanged joists like that shown in FIG. 5 joined in a perpendicular arrangement.

FIGS. 7 and 8 show how the relative positioning of the outermost center horizontal webs 29 and the flange inner webs 30 can be chosen advantageously. For instance, when the outer surfaces 31 of the outermost center horizontal webs 29 are positioned in the same plane or are the same distance apart as the inner surfaces 32 of the flange inner webs 30 and the flanges of one joist 33 have been notched out by an appropriate amount, the notched joist 33 can be easily inserted into another flanged joist 34 and secured by screws 35, as is shown in FIGS. 7 and 8. While this type of connection might not be sufficiently strong to transfer the load from one hollow flanged joist to the other and additional brackets or hangers might be needed (as are used when framing with wood), the connection should be sufficient to ensure that the hollow flanged joists remain firmly in place until they can be joined more securely.

Figure 9:
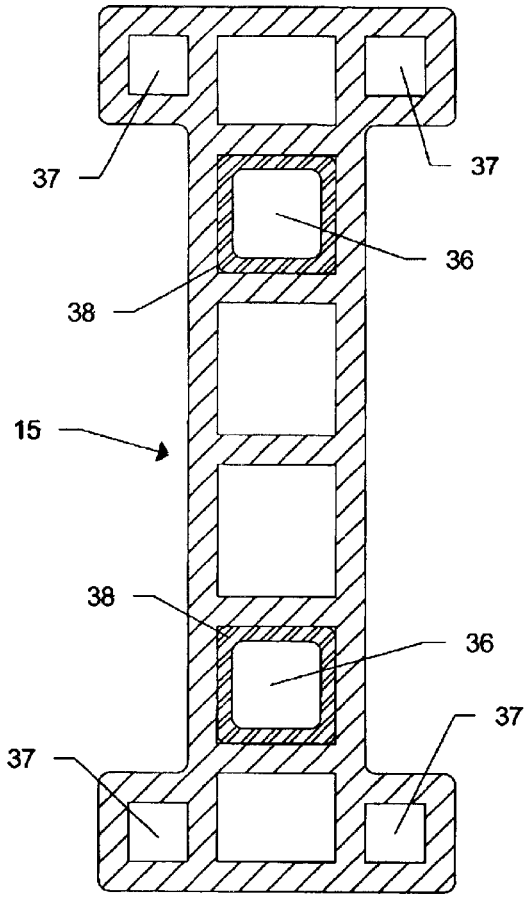
FIG. 9 is a cross-sectional view of one embodiment of reinforcing means for the hollow flanged joist shown in FIG. 5.
Figure 10:
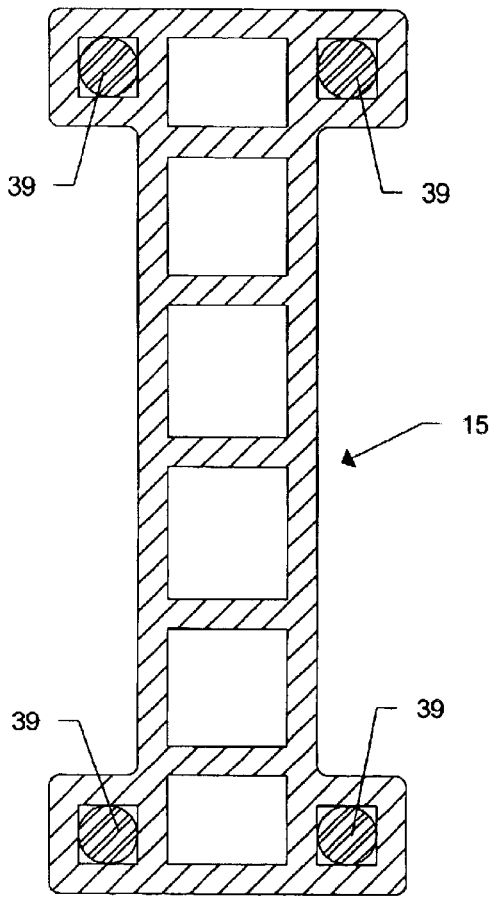
FIG. 10 is a cross-sectional view of a second embodiment of reinforcing means for the hollow flanged joist shown in FIG. 5.

FIGS. 9 and 10 show how it is possible to reinforce the hollow flanged joist 15 shown in FIG. 5 by inserting various reinforcing elements into the various hollow channels in the center web 36 or in the flanges 37 of the hollow flanged joist 15. These reinforcing elements might include metal tubing 38 as is shown in FIG. 9 or metal rods 39 as is shown in FIG. 10. The various hollow channels in the hollow flanged joist can be designed so that the reinforcing elements can be inserted into the hollow flanged joist to provide additional strength and stiffness, as required and if required in a particular application.

Figure 11:
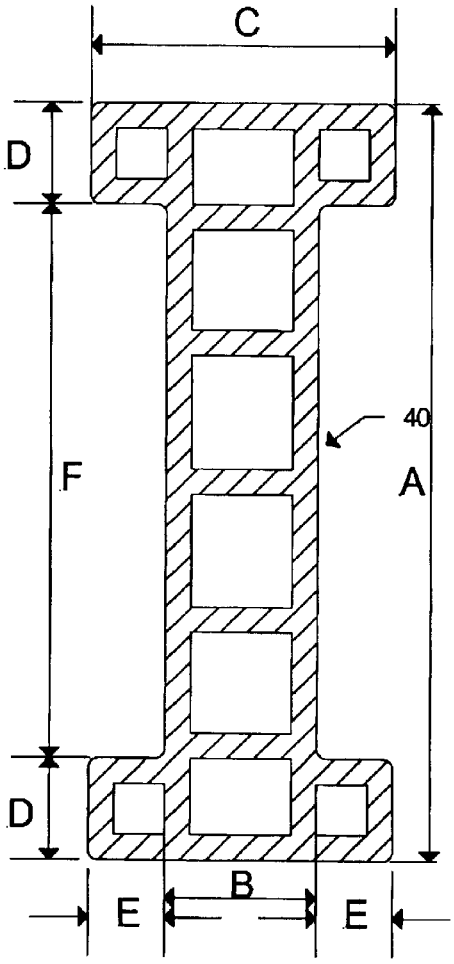
FIG. 11 is a cross-sectional view of the hollow flanged joist shown in FIG. 5 with various critical dimensions indicated.
Figure 12:
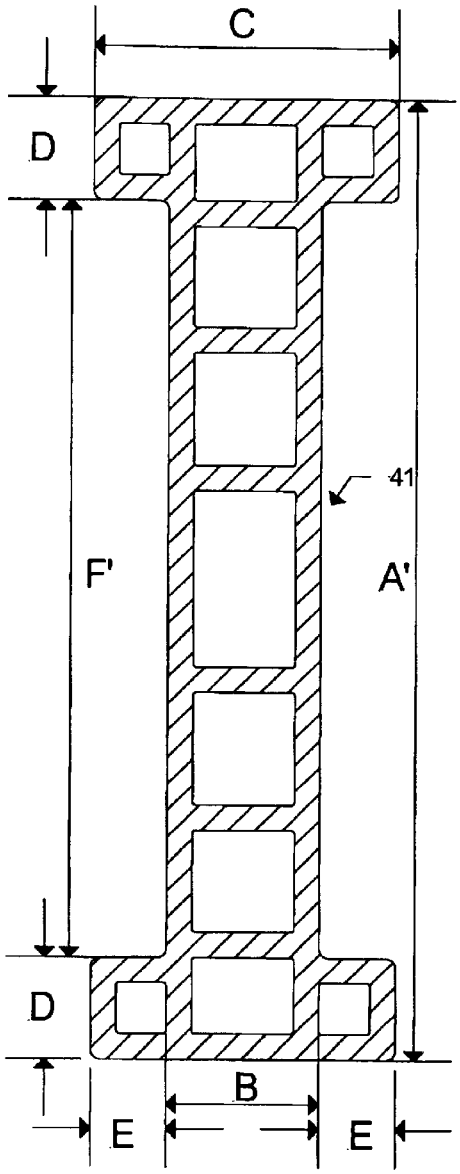
FIG. 12 is a cross-sectional view of a sixth embodiment of a hollow flanged joist of the present invention with various critical dimensions indicated.

In the construction of decks it would be useful that the hollow flanged joists be of a size and shape that are similar to the standard wood joists (i.e. 2×6, 2×8, 2×10, 2×12) which are in use currently, as that would allow for easier acceptance of and conversion to the new profiles. Two such hollow flanged joists 40, 41 are shown in FIGS. 11 and 12. The hollow flanged joists 40, 41 have vertical dimensions A and A' which are 7.5 in. and 9.5 in., respectively, and a center web width B which is 1.5 in. These heights and width correspond to the dimensions of nominal 2×8 and 2×10 joists, which are actually about 1.5 in. wide and about 7.5 in. and about 9.5 in. in height, respectively. The top and bottom flanges of both of these hollow flanged joists have a width C of about 3 in, a height or thickness D of about 1 in, and extend a distance E of about 0.75 in. on either side of the center web section. With flanges so dimensioned, the resulting distances F and F' between the flanges of the hollow flanged joists 40, 41 are 5.5 in. and 7.5 in., respectively, which are the actual heights of nominal 2×6 and 2×8 joists. It will apparent to those skilled in the art, that hollow flanged joists similar in configuration to those shown in FIGS. 11 and 12 could be designed as replacement for wooden 2×6 and 2×12 joists, if it was desired.

Figure 13:
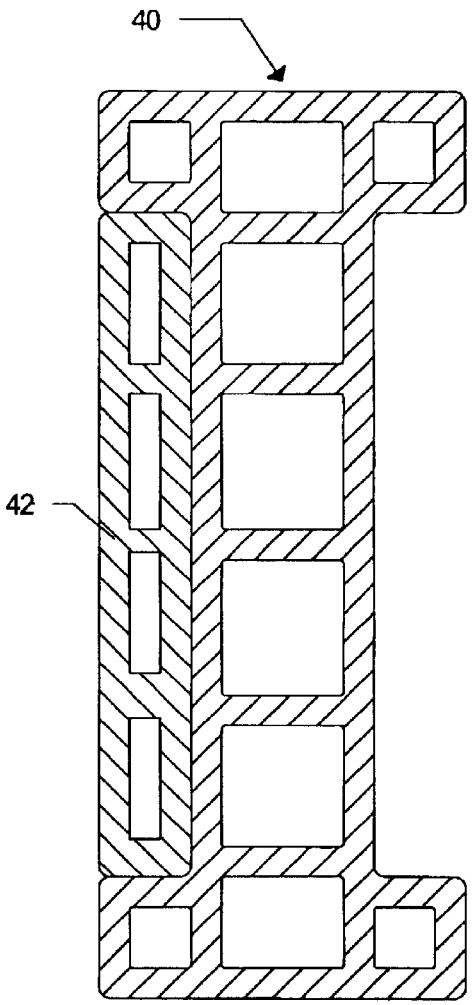
FIG. 13 is a cross-sectional view of one embodiment of a filling and reinforcing means for the hollow flanged joist shown in FIG. 5.
Figure 14:
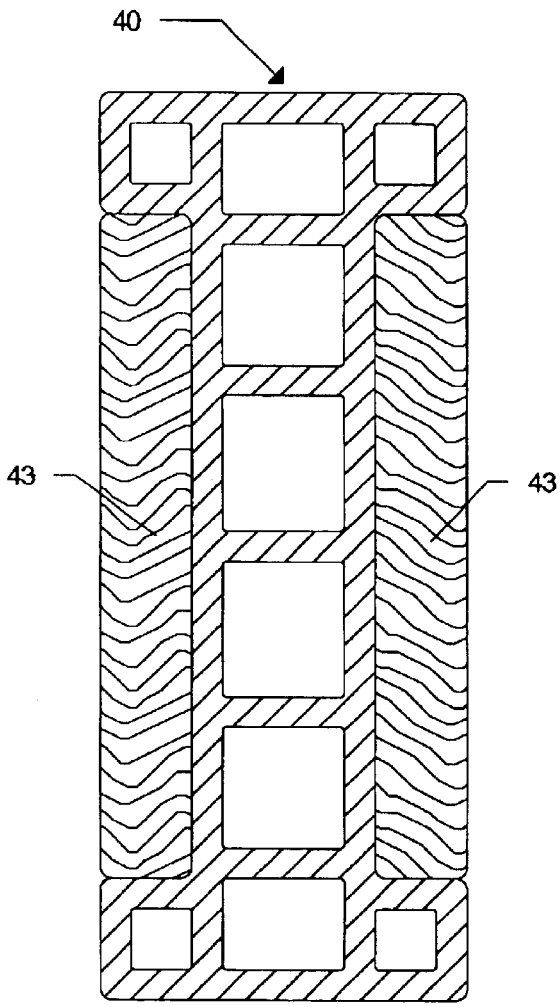
FIG. 14 is a cross-sectional view of a second embodiment of a filling and reinforcing means for the hollow flanged joist shown in FIG. 5.

One of the advantages of the hollow flanged joists as described in the previous paragraph is shown in FIGS. 13 and 14, which show how the hollow flanged joist 40 shown in FIG. 11 can be reinforced with additional profiles. The profiles, which can be solid 42 or hollow 43, are inserted on the sides of the joist between the top and bottom flanges. For the appropriately shaped hollow flanged joists as described in the previous paragraph, the sizes of the inserted profiles would correspond to nominal 1 in. thick profiles (i.e. 1×4, 1×6, 1×8, 1×10) which are typically about 0.75 in. thick. In addition to acting as reinforcing elements, the inserted profiles could also be used as filler pieces in situations such as mounting a hollow flanged joist on the outside wall of a house to support a deck or in attaching a post to the hollow flanged joist which would serve as a railing post.

Figure 17:
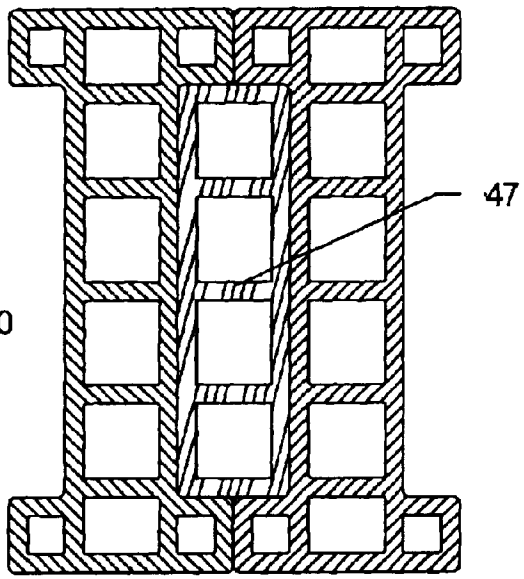
FIG. 17 is a cross-sectional view of a third embodiment of a beam formed from joining for two hollow flanged joists like that shown in FIG. 5 and having a second embodiment of a reinforcing means therebetween.
Figure 16:
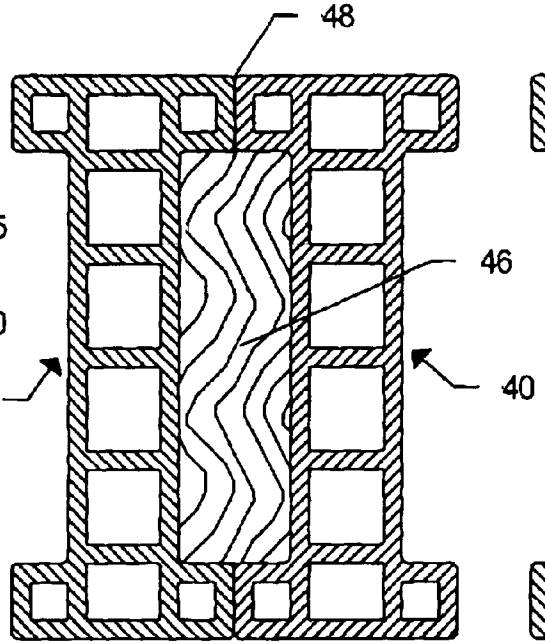
FIG. 16 is a cross-sectional view of a second embodiment of a beam formed from a joining for two hollow flanged joists like that shown in FIG. 5 and having one embodiment of a reinforcing means therebetween.
Figure 15:
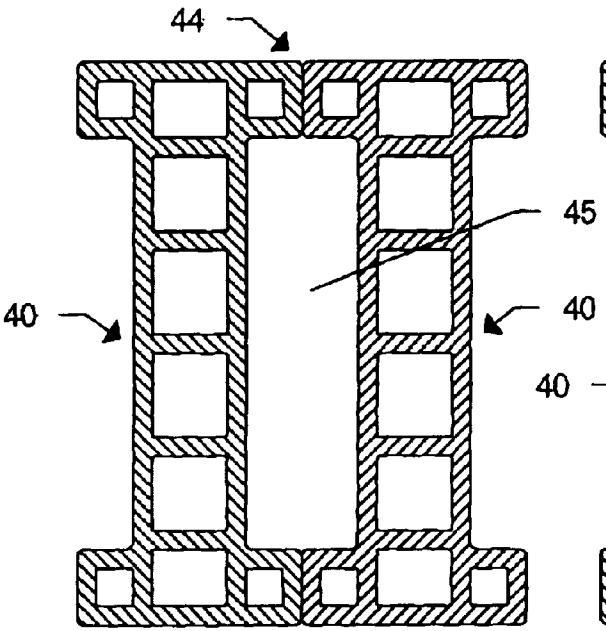
FIG. 15 is a cross-sectional view of one embodiment of a beam formed from two hollow flanged joists like that shown in FIG. 5.
Figure 18:
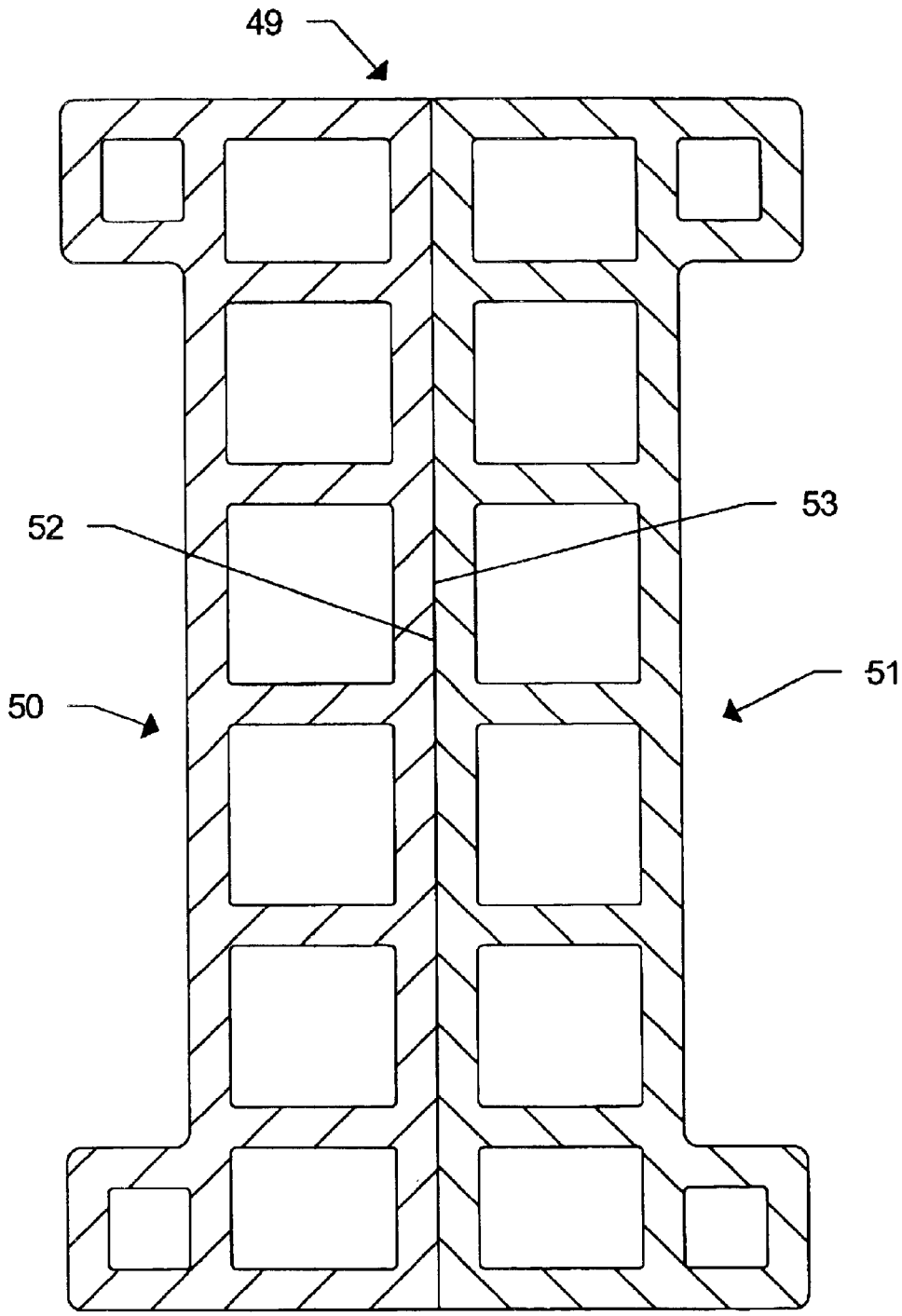
FIG. 18 is a cross-sectional view of a fourth embodiment of a beam formed from two hollow flanged joists like that shown in FIG. 5 after portions of the flanges of both joists have been selectively removed.

Another advantage of the hollow flanged joists with proportions as described above can be seen in FIGS. 15–17. FIG. 15 shows a beam 44 which is formed when two hollow flanged joists 40 (as shown in FIG. 11) are positioned side by side and joined together. Such a beam may be used to support a deck at an end which is not attached to the wall of a house. As can be seen, a hollow channel 45 results between the two hollow flanged joists 40. In this case, where hollow flanged joists are 3 in. wide and nominally 8 in. tall (actually about 7.5 in. tall), the resulting dimensions of the hollow channel 45 correspond to the actual size of a nominal 2×6, about 1.5 in. by 5.5 in. Similarly, two 3 in. by 10 in. hollow flanged joists positioned side by side would create a channel equal in size to a nominal 2×8. The advantage of this is shown in FIG. 16, where a solid profile 46, which could be a standard sized wood joist, is inserted between the two hollow flanged joists, and in FIG. 17, where a hollow profile 47 is inserted instead. It is possible to use a hollow profile which could be similar in composition to the hollow flanged joists, as shown in FIG. 17. In the case where the solid profile 46 is a wood joist, a bead of caulking could be applied to the seam 48 between the two hollow flanged joists 40 to prevent water from reaching the wood, thus protecting it from exposure to moisture. There are a number of reasons for wanting to place an additional profile 47 or a piece of wood 46 between the two hollow flanged joists 40, including that the additional profile would act as reinforcement for the beam and that the additional profile could aid in the fastening together of the two hollow flanged joists 40. FIG. 18 shows an alternate beam 49 made of two hollow flanged joists 50,51. These joists are modified by removing the flanges on the adjoining sides 52, 53.

There is a wide choice of materials from which to produce the hollow flanged joists by extrusion or pultrusion. However, the selection of the material will be governed by the desire to produce a hollow flanged joist which is resistant to moisture, sufficiently strong and stiff and is cost effective. As the hollow flanged joists of this invention are to serve primarily as replacements for wood joists in the construction of decks using non-wood decking products, which are moisture resistant and are primarily extruded or pultruded, the materials which are used to produce the decking products can serve as a guide for possible material choices. Non-wood decking products are currently produced from a wide range of materials including thermosetting and thermoplastic resins which may contain reinforcing fillers. The non-wood decking products produced via pultrusion are typically made with thermosetting resins reinforced with continuous fibers such as glass fiber or carbon fiber and are generally more expensive than products made from thermoplastic resins. The non-wood decking products produced from thermoplastic resins are typically produced via extrusion and are produced from virgin and recycled resins with and without reinforcing fillers, the reinforcing filler typically being discontinuous or short fiber fillers. Essentially all of the non-wood decking products produced with thermoplastic resins are made from either polyethylene (PE), polypropylene (PP), polystyrene (PS) or polyvinyl chloride (PVC), which are available quite readily in virgin or less readily in recycled forms. Non-wood decking products are available that are made with unfilled PE, PS and PVC and filled PE, PP and PVC. The most common type of reinforcing filler used in producing thermoplastic non-wood decking products are chopped glass fibers and cellulosic fibers. While glass fibers are substantially stronger and stiffer than cellulosic fibers, the glass fibers are considerably more expensive. The kinds of cellulosic fibers used in producing non-wood decking products are derived by the comminution or attrition by grinding or milling of wood, plant matter or agricultural byproducts such as hulls, husks, shells and straws to produce discrete fibers or cellulosic particles. Cellulosic fibers which are a byproduct of paper production or recycling are also being used in the production of non-wood decking materials. In addition to being cheaper than glass fibers, cellulosic fibers are typically cheaper than the thermoplastic resins in which they are used as fillers, so a higher cellulosic fiber content in the resin used to produce the non-wood decking product results in a lower cost product. Higher cellulosic fiber content can also result in improved mechanical properties such as strength and stiffness. However, too high a cellulosic fiber content will result in a product which may not be as moisture resistant as desired and may be quite brittle. The above discussion in regards to the materials used to produce non-wood decking products can be used as a guide to selecting appropriate materials from which the hollow flanged joists of this invention may be produced.

By way of example to illustrate the advantages of the hollow flanged joist, it is interesting to compare the span which may be achieved with a solid joist, a hollow joist and a hollow flanged joist of comparable dimensions and produced from the same material. In this comparison, it is assumed that the material used is unfilled PVC with a flexural modulus of 380,000 psi (2.6 Gpa) as given by several PVC decking manufacturers. The solid joist is 7.5 in. high and 1.5 in. wide (a nominal 2×8), while the hollow joist is 7.5 in. high, 1.5 in. wide, has two vertical webs 7.5 in. long and seven horizontal webs with one located at the vertical center of the joist and three pairs of horizontal webs located 1.375 in., 2.625 in. and 3.625 in. from the vertical center, respectively. All of the inside and outside webs are 0.25 in. thick. Finally, the hollow flanged joist is 7.5 in. high, the center web section is 1.5 in. wide, the flanges are 3 in. wide and 1 in. high, the center web section has 5 horizontal inside center webs with one located at the vertical center, a two pairs of webs located 1.375 in. and 2.625 in. from the vertical center, respectively, the center vertical webs extend from the top flange end web to the bottom flange end web and all of the inside and outside webs are 0.25 in. thick. Assuming a uniform total loading of 50 lbs/ft$^2$ (10 lb/ft$^2$ dead load and 40 lb/ft$^2$ live load) on a deck with joists spaced 16 in. on center and simply supported, the maximum allowable span for a maximum allowable deflection of $1/360^{th}$ of the span is given in Table 1, along with the cross-sectional area and the moment of inertia ($I_x$) about the vertical center of mass of each joist (used to determine the deflection of the joists under load). As can be seen in Table 1, the cross sectional area of the hollow joist is substantially less than that of the solid joist (51.1% less), while the area of the hollow flanged joist is more than that of the hollow joist (36.4% more) but less than that of the solid joist (33.3% less). However, while the moment of inertia of the hollow joist is substantially less than that of the solid joist (45.9% less), the moment of inertia of the hollow flanged joist is only marginally less than that of the solid joist (5.4% less). In comparing the maximum allowable spans, the maximum allowable span for the hollow joist is significantly less than that of the solid joist (18.7%), while the maximum allowable span for the hollow flanged joist is only marginally less than that of the solid joist (2.2% less). From the above discussion, it can be seen that while the hollow joist can substantially reduce the amount of material required in comparison to the solid joist, it cannot span the same distance as the hollow flanged joist, which also uses substantially less material than the solid joist.

TABLE 1

| Profile | Area (in.$^2$) | $I_x$ (in.$^4$) | Allowable span (in.) |
|---|---|---|---|
| Solid joist (2 × 8) | 11.25 | 52.73 | 91.7 |
| Hollow joist (2 × 8) | 5.5 | 28.54 | 74.6 |
| Hollow flanged joist (3 × 8) | 7.5 | 49.88 | 89.7 |

As used herein, the terms "comprises" and "comprising" are to be construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

It is to be understood that while certain embodiments of this invention have been described above, the invention is not to be limited to the specific embodiments shown and described. It will be apparent to those skilled in the art that various changes may be made without departing from the scope of the invention and the invention is not to be considered limited to what is shown in the drawings and described in the specification.

What is claimed is:

1. A hollow flanged joist comprising:

a center web section having two center vertical webs and at least one center horizontal web extending between the center vertical webs and generally perpendicular thereto, the center web section having a top end, a bottom end, a right side and a left side and having generally a constant width;

a top flange section projecting generally perpendicularly from and substantially beyond the left and right sides of the top end of the center web section, the top flange section having a horizontal flange end web with a left and a right end and a length which exceeds the width of the center web section, a left and right vertical flange side web, each having an inner and an outer end, wherein the outer ends of the left and right flange side webs connect to and extend downwardly and generally perpendicularly from the left and right ends, respectively, of the flange end web, and a left and right horizontal flange inner web, projecting outwardly from the left and right sides, respectively, of the top end of the center web section to the inner ends of the left and right flange side webs, respectively; and a bottom flange section projecting generally perpendicularly from and substantially beyond the left and right sides of the bottom end of the center web section, the bottom flange section having a horizontal flange end web with a left and a right end and a length which exceeds the width of the center web section, a left and right vertical flange side web, each having an inner and an outer end, wherein the outer ends of the left and right flange side webs connect to and extend upwardly and generally perpendicularly from the left and right ends respectively of the flange end web, and a left and right horizontal flange inner web, projecting outwardly from the left and right sides, respectively, of the bottom end of the center web section to the inner ends of the left and right flange side webs, respectively.

2. The hollow flanged joist of claim 1 further including a plurality of center horizontal webs extending between the center vertical webs and generally perpendicular thereto.

3. The hollow flanged joist of claim 1, wherein the hollow flanged joist has an overall horizontal dimension of between about 2 and about 6 inches, an overall vertical dimension of between about 5 and about 16 inches, a distance between exterior surfaces of the center vertical webs between about 0.75 and about 3 inches, a distance between exterior surfaces of the top flange end web and flange inner webs and the bottom flange end web and flange inner webs, respectively, between about ½ and about 2 inches, and a thickness of each web between about 1/32 and about ½ of an inch.

4. The hollow flanged joist of claim 3, wherein the thickness of each web is between about 1/16 and about ⅜ of an inch.

5. The hollow flanged joist of claim 3, wherein the thickness of each web is about ¼ of an inch.

6. The hollow flanged joist of claim 1, wherein the hollow flanged joist has an outer surface and the outer surface has integral markings formed therein whereby the integral markings are used to indicate specific positions on the hollow flanged joist.

7. The hollow flanged joist of claim 1, wherein the hollow flanged joist has a plurality of longitudinal hollow channels each adapted to receive a reinforcing insert.

8. The hollow flanged joist of claim 7, further including a plurality of reinforcing insert wherein the reinforcing inserts are chosen from the group consisting of metal tubing and rods.

9. The hollow flanged joist of claim 1, wherein the hollow flanged joist is adapted to receive at least one additional profile between the top flange and the bottom flange on either side of the center web section.

10. The hollow flanged joist of claim 9, wherein the additional profile is chosen from the group consisting of a solid profile and a hollow profile.

11. The hollow flanged joist of claim 1, further including a second hollow flanged joist attached to the hollow flanged joist to form a beam, wherein the top and bottom flange side webs on one side of the hollow flanged joist are positioned adjacent to the top and bottom flange side webs on one side of the second hollow flanged joist and a hollow channel is formed therebetween.

12. The hollow flanged joist of claim 11, wherein a reinforcing profile is positioned in the hollow channel between the adjacent hollow flanged joists.

13. The hollow flanged joist of claim 12, wherein the reinforcing profile is chosen from the group consisting of a solid profile and a hollow profile.

14. The hollow flanged joist of claim 1, further including a second hollow flanged joist attached to the hollow flanged joist to form a beam, wherein the ends of the top and bottom flanges on one side of each of the two hollow flanged joists are removed and the two hollow flanged joists are joined along the outside center webs on the sides of the two hollow flanged joists that have had the flanges removed.

15. The hollow flanged joist of claim 1, wherein the hollow flanged joist is manufactured by way of extrusion.

16. The hollow flanged joist of claim 15, wherein the hollow flanged joist is manufactured from one of aluminum and an aluminum alloy.

17. The hollow flanged joist of claim 15, wherein the hollow flanged joist is manufactured from one of a thermoplastic resin, a blend of thermoplastic resins and a mixture of thermoplastic resins.

18. The hollow flanged joist of claim 17, wherein the thermoplastic resin is one of a virgin material, a recycled material and a mixture thereof.

19. The hollow flanged joist of claim 17, wherein the thermoplastic resin contains one of a reinforcing filler, a mixture of reinforcing fillers and a combination of reinforcing fillers.

20. The hollow flanged joist of claim 19, wherein the reinforcing filler is chosen from the group consisting of glass fibers, carbon fibers, metallic fibers, thermoplastic fibers, and mixtures thereof.

21. The hollow flanged joist of claim 19, wherein the reinforcing filler is one of cellulosic fibers, cellulosic particles, and mixtures thereof.

22. The hollow flanged joist of claim 21, wherein the reinforcing filler is derived by comminution and attrition by grinding and milling of materials chosen from the group consisting of wood, plant matter, hulls, husks, shells and straws.

23. The hollow flanged joist of claim 21, wherein the reinforcing filler is chosen from the group consisting of byproducts of paper production and recycling.

24. The hollow flanged joist of claim 19, wherein the reinforcing filler is mineral fillers chosen from the group consisting of talc, mica, calcium carbonate, clays and mixtures thereof.

25. The hollow flanged joist of claim 15, wherein the hollow flanged joist is manufactured from a thermosetting resin.

26. The hollow flanged joist of claim 25, wherein the thermosetting resin contains reinforcing fibers chosen from the group consisting of glass fibers, carbon fibers, metallic fibers, thermoplastic fibers, and mixtures thereof.

27. The hollow flanged joist of claim 1, wherein the hollow flanged joist is manufactured by way of pultrusion.

28. The hollow flanged joist of claim 27, wherein the hollow flanged joist comprises a thermosetting resin which contains reinforcing fibers chosen from the group consisting of glass fibers, carbon fibers, metallic fibers, thermoplastic fibers, and mixtures thereof.

29. The hollow flanged joist of claim 27, wherein the hollow flanged joist comprises a thermoplastic resin which contains reinforcing fibers chosen from the group consisting of glass fibers, carbon fibers, metallic fibers, thermoplastic fibers, and mixtures thereof.

30. A hollow flanged joist comprising:

a center web section having a two center vertical webs and a plurality of center horizontal webs extending between the center vertical webs and generally perpendicular thereto, the center web section having a top end, a bottom end, a right side and a left side and having generally a constant width:

a top flange section projecting generally perpendicular to and substantially beyond the left and right sides of the top end of the center web section, the top flange section having a horizontal flange end web with a left and a right end and a length which exceeds the width of the center web section, a left and a right vertical flange side web, each having an inner and an outer end, wherein the outer ends of the left and right flange side webs connect to and extend downwardly and generally perpendicularly from the left and right ends respectively of the flange end web, a left and a right horizontal flange inner web projecting outwardly from the left and right sides, respectively, of the top end of the center web section to the inner ends of the left and right flange side webs, respectively, and at least one top flange support web extending between the top flange end web and one of an inside center web and one of the pair of top flange inner webs; and a bottom flange section projecting generally perpendicular to and substantially beyond the left and right sides of the bottom end of the center web section, the bottom flange section having a horizontal flange end web with a left and a right end and a length which exceeds the width of the center web section, a left and a right vertical flange side web, each having an inner and an outer end, wherein the outer ends of the left and right flange side webs connect to and extend upwardly and generally perpendicularly from the left and right ends respectively of the flange end web, a left and a right horizontal flange projecting outwardly from the left and right sides, respectively, of the bottom end of the center web section to the inner ends of the left and right flange side webs, respectively, and at least one bottom flange support web extending between the bottom flange end web and one of an inside center web and one of the pair of bottom flange inner webs.

31. The hollow flanged joist of claim 30 further including a pair of top flange support webs and a pair of bottom flange support webs and wherein each top flange and bottom flange support web is an extension of one of the center vertical webs such that each center vertical web extends between the top flange end web and the bottom flange end web.

32. The hollow flanged joist of claim 31, wherein outermost surfaces of two center horizontal webs furthest from the vertical center of the hollow flanged joist are in the same plane as the exterior surfaces of the top and bottom flange inner webs, respectively.

33. The hollow flanged joist of claim 32, wherein the hollow flanged joist has an overall horizontal dimension of about 3 inches, a distance between exterior surfaces of the top flange end web and flange inner webs and the bottom flange end web and flange inner webs, respectively, of about 1 inch and a distance between exterior surfaces of the center vertical webs of about 1.5 inches.

34. The hollow flanged joist of claim 33, wherein the hollow flanged joist has a nominal overall vertical dimension chosen from the group consisting of 8, 10 and 12 inches.

35. The hollow flanged joist of claim 33, wherein the hollow flanged joist has an overall vertical dimension chosen from the group consisting of about 7.5, 9.5 and 11.5 inches.

* * * * *